United States Patent [19]

Klein

[11] Patent Number: 4,800,961

[45] Date of Patent: Jan. 31, 1989

[54] SPRINKLER OR FIRE-EXTINGUISHING NOZZLE

[76] Inventor: Wilfried Klein, Lindlarer Str. 79, 5063 Overath-Immekeppel, Fed. Rep. of Germany

[21] Appl. No.: 16,027

[22] Filed: Feb. 18, 1987

[30] Foreign Application Priority Data

Jul. 23, 1986 [DE] Fed. Rep. of Germany ..... 3624939

[51] Int. Cl.[4] ..... A62C 37/10

[52] U.S. Cl. ..... 169/37; 169/39; 239/590.5

[58] Field of Search ..... 169/37–41, 169/90, 5, 13, 16; 239/490, 461, 463, 548, 553, 589, 590, 590.5, 533.1, 76

[56] References Cited

U.S. PATENT DOCUMENTS

| | | | |
|---|---|---|---|
| 2,295,228 | 9/1942 | Malsbary et al. | 239/590 X |
| 2,893,646 | 7/1959 | Batts | 239/553 X |
| 4,151,955 | 5/1979 | Stouffer | 239/590 X |
| 4,434,855 | 3/1984 | Given, Jr. | 169/37 |

FOREIGN PATENT DOCUMENTS

| | | | |
|---|---|---|---|
| 216828 | 1/1961 | Austria | 239/548 |
| 2539703 | 3/1977 | Fed. Rep. of Germany . | |
| 2639245 | 3/1978 | Fed. Rep. of Germany . | |
| 2716544 | 10/1978 | Fed. Rep. of Germany . | |
| 2428446 | 1/1983 | Fed. Rep. of Germany . | |
| 200217 | 3/1983 | Fed. Rep. of Germany | 239/589 |
| 971690 | 1/1951 | France | 239/589 |
| 446237 | 3/1949 | Italy | 169/37 |
| 19011 | 10/1908 | Norway | 239/461 |
| 207158 | 9/1966 | Sweden | 169/37 |

*Primary Examiner*—Joseph F. Peters, Jr.
*Assistant Examiner*—James M. Kannofsky
*Attorney, Agent, or Firm*—Sprung, Horn, Kramer & Woods

[57] ABSTRACT

In a sprinkler or spray nozzle for on-site fire-extinguishing systems provided with at least one intake opening (11) and with at least one outlet opening (16) downstream of the intake opening, and optionally provided with a downstream deflector, the outlet opening determining the flow of liquid of liquid fire-extinguishing agent in accordance with the pressure on the agent, the improvement wherein the open cross-section of the intake opening is smaller to a prescribed extent than the open cross-section of the outlet opening, and the nozzle includes a connector with an open cross-section that initially tapers out like that of a diffuser from the intake opening toward the outlet opening over at least part of its length and then contracts into a constriction (9) positioned between the intake opening and its associated outlet opening.

12 Claims, 9 Drawing Sheets

SPRINKLER OR FIRE-EXTINGUISHING NOZZLE

BACKGROUND OF THE INVENTION

The present invention relates to a sprinkler or spray nozzle for on-site fire-extinguishing systems with at least one outlet opening 6 that determines the flow of liquid fire-extinguishing agent in accordance with the pressure on the agent and with or without a downstream deflector 4.

Stationary fire-extinguishing systems are employed to prevent damage from conflagrations in large structures such as department stores, industrial plants, warehouses, garages, etc. The density of the pipeline network depends on local ordinances. Sprinklers, as employed herein also intended to embrace fire-extinguishing nozzles are positioned at the ends of the pipeline.

Sprinkler nozzles of the type known from German patents Nos. 2 428 446, 2 539 703, 2 639 245, and 2 716 544 for example are manufactured worldwide today mainly in the three sizes K 57, K 80, and K 115, with outflow cross-sections of approximately 0.7, 1.0, and 1.4 $cm^2$ respectively, and more rarely in other dimensions. The flow constant K represents the water-outflow rate Q in liters per minute at 1 bar of above-atmospheric pressure upstream of the sprinkler. K can also be expressed in other units. In this case the values become different since the sprinklers are intended to function at above-atmospheric pressures ranging from at least approximately 0.5 bar to approximately 5 bar, the actual water-outflow rate of a sprinkler of current design can be obtained from the formula $$Q = K\sqrt{p}$$

wherein

Q=flow rate in liters per minute

K=flow at an above-atmospheric pressure of 1 bar, and p=above-atmospheric pressure upstream of the sprinkler.

The effect of how fast the water is supplied is ignored here because any errors that derive from it are negligibly small given the pipe dimensions and flow rates prevailing in sprinkler systems.

Since pipes of unequal length lead from the water-supply line to the individual sprinklers or fire-extinguishing nozzles in fire-extinguishing systems of this type, the pressure losses in the pipes and hence the pressures at the individual sprinklers or fire-extinguishing nozzles will differ. The water-supply lines and pipelines are accordingly dimensioned to ensure that—even in the worst possible case, when all the sprinklers or fire-extinguishing nozzles in the operational area (the area over which all the sprinklers or fire-extinguishing nozzles have to be adequately supplied with water) are completely open—there will be sufficient pressure for unobjectionable function even at the sprinkler or fire-extinguishing nozzle at the end of the longest length of piping and accordingly subject—due to the greatest pressure drop—to the lowest pressure in the system.

Since all the other sprinklers in the system will accordingly be subjected to higher-than-necessary pressure and will accordingly experience greater flow than the worst-located sprinkler, the amount of water exiting over the total operational area will always be greater than theoretically necessary for the system. Thus degrees of non-uniformity of around 140% or more of the theoretically requisite amount of water are common, and pumps, pipelines, reservoirs, power, etc. must be installed to handle the excess. This makes the equipment more extensive and costly.

SUMMARY OF THE INVENTION

The object of the present invention is to eliminate this unnecessary expense.

It has surprisingly been discovered that this object can be attained in a sprinkler of the aforesaid type by the improvement wherein one or more intake openings (11) are positioned upstream of the outlet opening or openings (6), with the open cross-section of the intake openings being smaller to a prescribed extent than the open cross-section of the outlet opening or openings and wherein a connector, with an open cross-section that initially tapers out like that of a diffuser from the intake opening toward the outlet opening over at least part of its length and then contracts into a constriction (9), is positioned between each intake opening and its associated outlet opening.

The design in accordance with the invention makes it possible to save as much as 15% in water and as much as 30% in power along with considerable installation costs. The design in accordance with the invention also leads to the formation of larger drops of water, which current research has demonstrated considerably increases the extinguishing effect of the sprinkler.

The constriction (9) in one embodiment of the invention can have an extensive open cross-section.

A choking disk can be positioned upstream of each outlet opening (6).

The constriction (9) can be a cylindrical pipe of a prescribed length.

The intake opening(s) (11), outlet opening(s) (6), and connector(s) can have a circular open cross-section.

The intake opening(s) (11) can be or have eccentric, preferably tangential torsion slots, accesses (40), or similar structures.

The outlet opening (6) can have an annular shoulder (21) that extends into it and that has toward the side of the intake opening a flat surface (20) preferably perpendicular to the axis of flow and a sharp inner edge.

The outlet end of the annular shoulder (21) can have a preferably conical expansion (22).

If the sprinkler has several outlet openings (6), there can be a central backup plate (27) between them.

The intake end of the intake opening(s) (11) can be rounded off.

If the sprinkler has a cap (30) that is connected to a deflector (4) by a release mechanism (31), the cap can be located in the intake opening (11).

The backup plate (27) can be designed to accommodate a cap (30) that tapers in toward the intake end and, when in the ready position, maintains the intake opening (11) in the ready position by means of a tie rod (33) that extends through the backup plate and is secured to a deflector 4.

BRIEF DESCRIPTION OF THE DRAWINGS

Some preferred embodiments of the invention will now be specified with reference to the attached drawings, wherein.

DETAILED DESCRIPTION OF THE PREFERRED EMBODIMENTS

Figure 1:
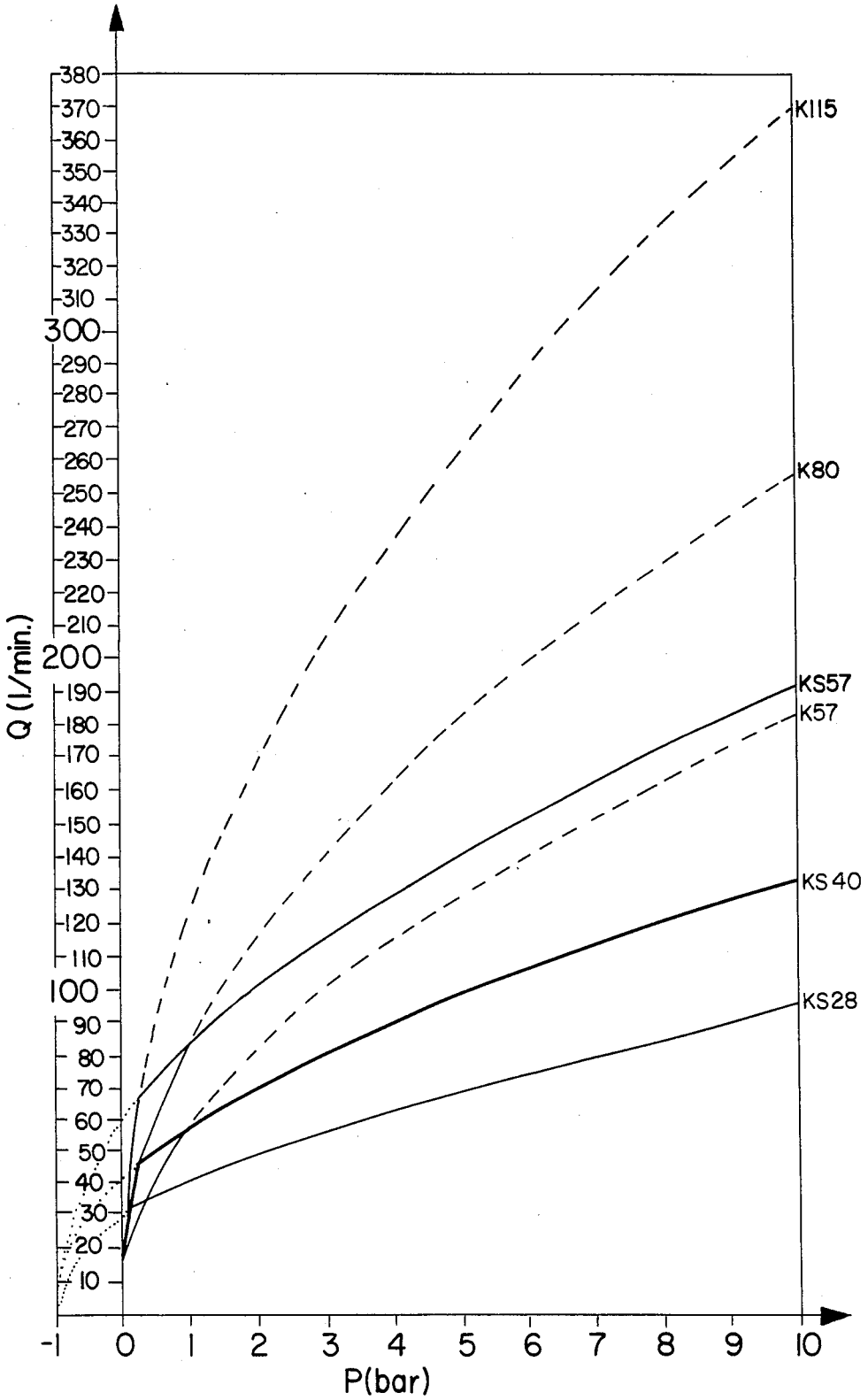
FIG. 1 is a graph of water-outflow rate Q as a function of above-atmospheric pressure p in a usual sprayer and in a sprayer in accordance with the invention.

The initially continuous and then broken curves in the graph in FIG. 1 represent the water-outflow rate Q in liters per minute at an above-atmospheric pressure in bar for the usual sprinkler sizes K 57, K 80, and K 115. If the velocity of the water-inflow rate is ignored, the water-outflow rate can be determined from these curves for above-atmospheric pressures ranging from 0 bar to a prescribed level in accordance with the formula $$Q = K\sqrt{p}\ .$$

Since another, smaller nozzle is positioned upstream of the outlet nozzle in a usual sprinkler in accordance with the invention and since both nozzles are connected by a connector with an open cross-section that tapers out from the smaller toward the larger nozzle, a partial vacuum will occur at the smaller nozzle. This partial vacuum can, depending on the design be as low as the vapor pressure of the water. Since water temperature is low and usually restricted to no more than 40° C. in sprinkler systems, the resulting vapor pressure will also be low, so that the additional pressure difference can usually be assumed to be 1 bar in sprinkler systems.

The main nozzle component can also have, instead of only one intake nozzle and one outlet nozzle, a single intake nozzle and two or more outlet nozzles. The main nozzle component can also have several intake openings or nozzles and only one outlet opening or nozzle as well as several intake and outlet nozzles or openings—the same number or different numbers. The only decisive factor is that the total open cross-section of the intake nozzle or nozzles be smaller to a prescribed extent than the total open cross-section of the outlet nozzle or nozzles, to ensure a partial vacuum at the intake-end nozzle or nozzles.

Given this pressure difference, accordingly, the formula for the water-outflow rate will now be $$Q = KS\sqrt{p+1}\ ,$$

wherein KS is the water-outflow rate in liters per minute at 1 bar of pressure drop between entry into and exit from the smaller nozzle and the 1 under the root symbol approximates the difference between the ambient pressure and the vapor pressure of the water. (Although this approximation is adequate for sprinkler systems, the formula is not precise because it ignores the inflow rate and the precise vapor pressure of the water.) The resulting water-outflow rates are represented by the initially dotted and then continuous curves KS 28, KS 40, and KS 57 in FIG. 1.

The sequence of two different nozzles in accordance with the invention accordingly results, however, in the water flow depending on two different outflow formulas.

Atmospheric pressure prevails at the exit from the downstream nozzle located directly at the sprinkler outlet, allowing the water to exit in accordance with the formula $$Q = K\sqrt{p}\ ,$$

At the upstream and smaller nozzle, however, the water pressure decreases as the flow increases until the vapor pressure of the water is attained. From that instant on, and not before, the water-outflow rate will conform to the formula $$Q = KS\sqrt{p+1}\ .$$

The thick continuous line in FIG. 1 represents an example of the measured flow through a nozzle in accordance with the invention for K 80/KS 40. The nozzle cross-sections can of course be selected to obtain almost any desired combination of K and KS curves, whereby FIG. 1 shows that water outflow will always conform to either $$Q = K\sqrt{p} \text{ or } Q = KS\sqrt{p+1}\ ,$$

depending on which is lower. Since the prevailing rules for sprinkler systems and water-spray fire-extinguishing systems dictate that the above-atmospheric pressure at the outlet nozzle shall always be at least about 0.5 bar, it also turns out to be practical to design the system so that the point of intersection of the K and KS curves, the break in the combined flow curve, that is, will always be located at 0.5 bar or less, resulting in the advantage that only the formula $$Q = KS\sqrt{p+1}\ ,$$

one that can easily be inserted into existing electronic-data processing programs, will have to be dealt with.

Figure 2:
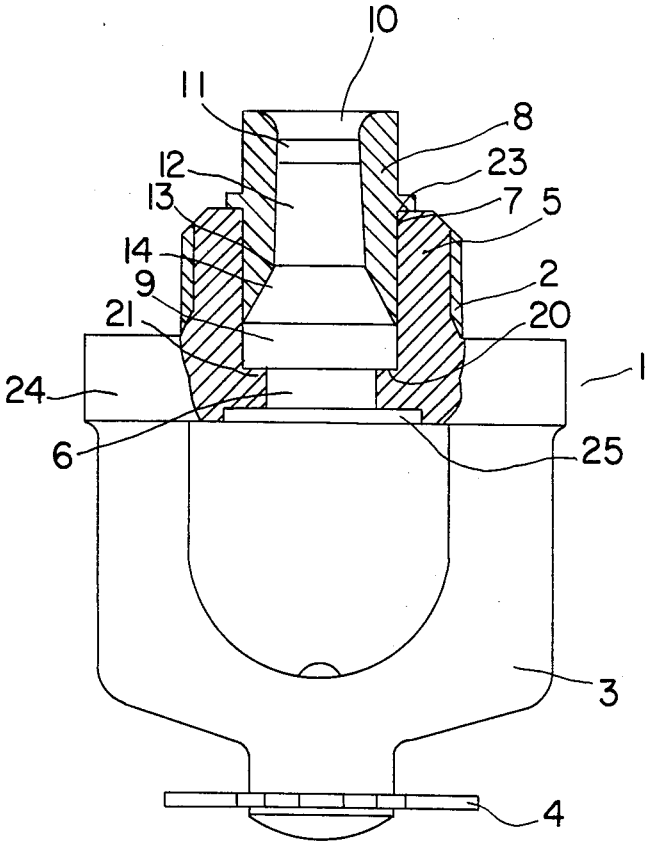
FIG. 2 is a partial section through one embodiment of a sprinkler in accordance with the invention.

The sprinkler 1 illustrated in FIG. 2 has the conventional connector 5 with a thread 2 and frame 3 with a deflector 4. The also conventional sealing and release components are not shown. Connector 5 has a cylindrical cavity 7 with a cross-section that is narrowed at the bottom into an outlet opening 6 followed by a cylindrically annular expansion 25. A Venturi insert 8 is positioned in bore 7 with its annular collar 23 resting against connector 5. Venturi insert 8 is longitudinally dimensioned to provide a constriction in the form of an eddy chamber 9 between outlet opening 6 and a diffuser 12. At the inlet 10 into Venturi insert 8 is an intake opening 11. The intake end of the insert is rounded off, with a radius $r=\frac{1}{8}$ of diameter Intake opening 11 merges, preferably rounded off, into diffuser 12, which expands in this case at an angle of approximately 8°. An expansion 14 downstream of diffuser 12 expands in this case for example at an angle of approximately 60°, commencing approximately at the point where the open cross-section of the diffuser is about 80% of that of outlet opening 6. The transition 13 from diffuser 12 to expansion 14 is rounded off in this case.

Figure 3:
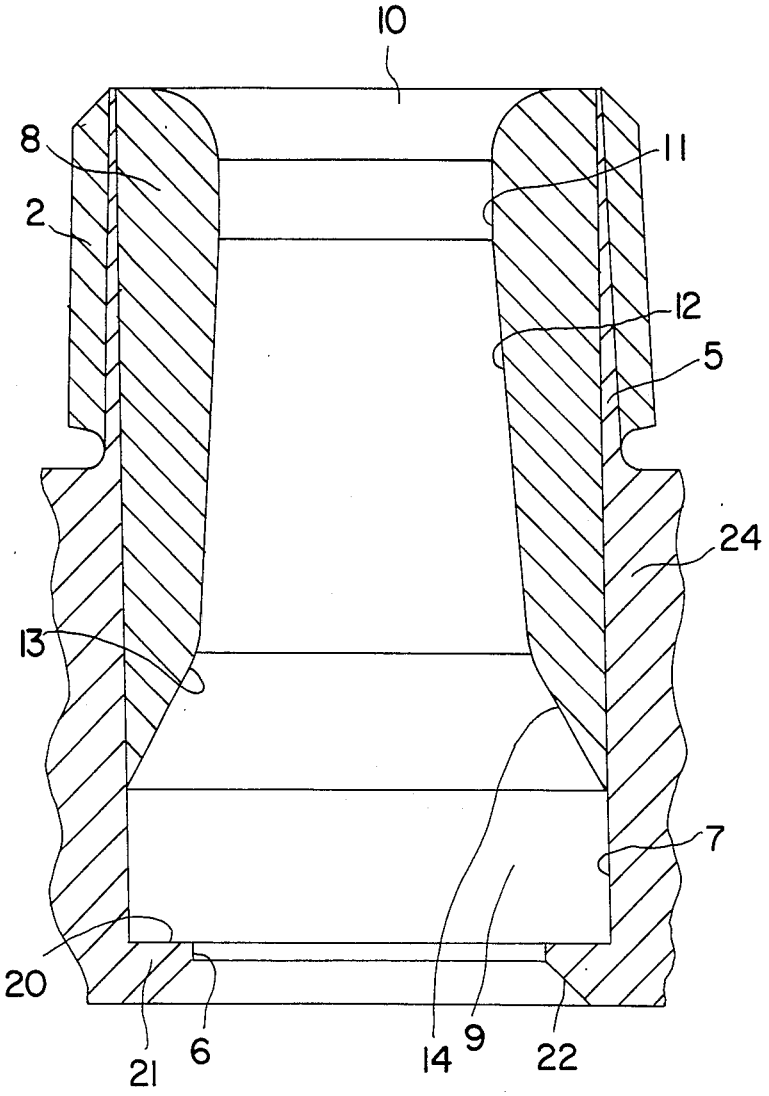
FIG. 3 is a larger-scale section through part of a variant of the embodiment illustrated in FIG. 2.

The Venturi insert 8 in the embodiment illustrated in FIG. 3, wherein the same reference numbers are employed for equivalent parts, is positioned with its total length in a cylindrical bore 7 in connector 5 or in the annular collar 24 that constitutes the transition to frame 3. The insert corresponds in principle to that illustrated in FIG. 2, with a rounded inlet 10 into a cylindrical intake opening 11, with a diffuser 12 that expands at an angle of approximately 8°, and with a subsequent expansion 14 at an angle of approximately 30°. The transition from intake opening 11 to diffuser 12 and the transition 13 from diffuser 12 to expansion 14 are also rounded off. In contrast to the embodiment illustrated in FIG. 2, however, the cylindrical length in this case is considerably shorter and a conical expansion 22 merges into cylindrical outlet opening 6. Bore 7 extends through an annular shoulder 21 or similar structure into outlet opening 6. The flat surface 20 of annular shoulder 21 is perpendicular to the direction of flow and extends over a sharp edge into cylindrical outlet opening 6.

The intersection between the K and KS curves mentioned with reference to FIG. 1, the break in the actual flow curve, that is, occurs at the above-atmospheric pressure of 0.5 bar or less cited in that passage when the open cross-section of outlet opening 6 is almost twice that of intake opening 11. Eddy chamber 9 should in this case have a diameter of about 1.2 times that of outlet opening 6, with its length being about $\frac{1}{3}$ its diameter.

The increased pressure between the smaller intake opening 11 and the larger outlet opening 6 results in a recovery of potential energy due to a decrease in kinetic energy. The exit speed of the fire-extinguishing medium is accordingly essentially lower than in usual sprinklers.

The advantage is that the decrease in exit speed in relation to usual sprinklers produces larger drops. According to *Fire Safety Journal* 9 (1985), 157–63, drop size should be proportional to (nozzle diameter:exit speed)$^{\frac{3}{2}}$. The diametric relation can be selected to decrease exit speed to almost any extent desired and hence affect the drops emerging from the sprinkler in accordance with the results of recent research, which indicate that drop size is of essential significance in successful extinction. This is an essential advantage of the sprinkler in accordance with the invention.

Conical expansion 22, which can of course be varied in many ways, causes, especially in conjunction with a cylindrical outlet opening 6 that is as short as possible, a small portion of the flowing water, specifically at the edge, to disassociate itself from the main jet in the form of fine or small drops. This happens because the water is resiliently compressed by the lateral afflux and, once it has passed through outlet opening 6, can expand laterally. The sprinkler accordingly generates in a practical process small and large drops simultaneously, specifically, that is, small drops in a relatively small peripheral area to lower flue-gas temperature or cool the environment in an emergency and large drops in the preponderant central area to continuously improve the extinguishing action.

Figure 4:
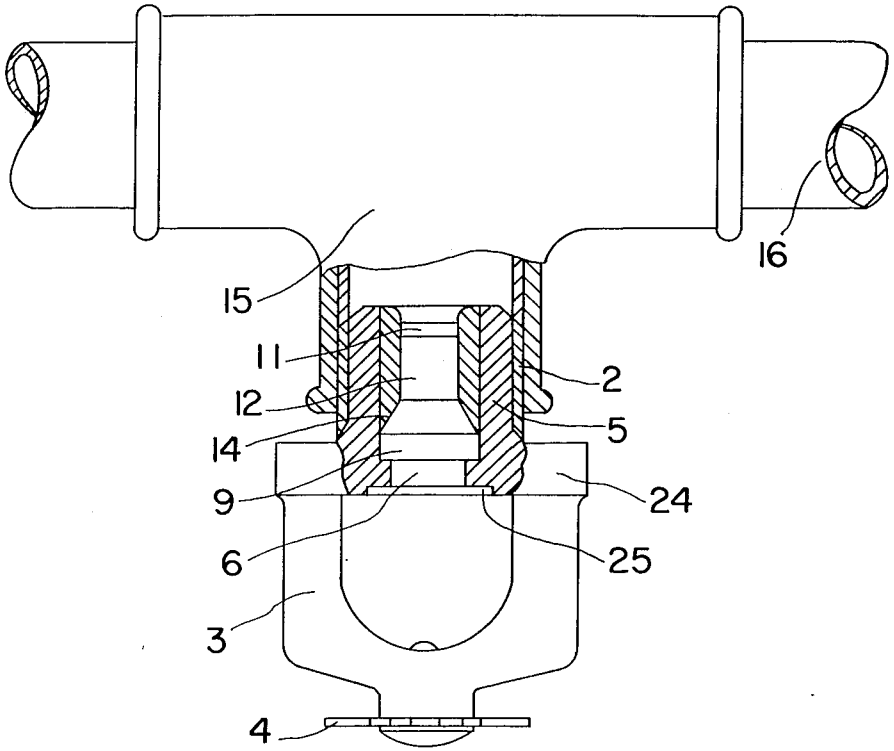
FIG. 4 illustrates how a sprinkler in accordance with the invention can be installed with a T connector.

FIG. 4 illustrates how a variant of the sprinkler illustrated in FIGS. 2 and 3 can be installed in the T connector 15 of a sprinkler pipeline 16 by screwing it in along thread 2. Equivalent components are again labeled with the same reference numbers.

Figure 5:
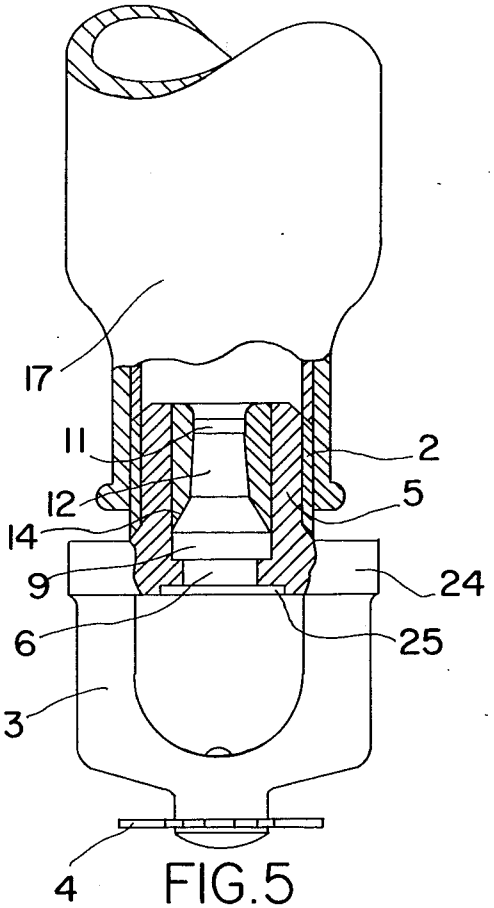
FIG. 5 illustrates how the sprinkler can be installed in a downpipe.

A similar sprinkler, on the other hand, in FIG. 5 is installed in, i.e. screwed into, the downpipe 17 of a sprinkler pipeline. It can of course also be fitted into a riser or into an outgoing pipe of any orientation.

Figure 6:
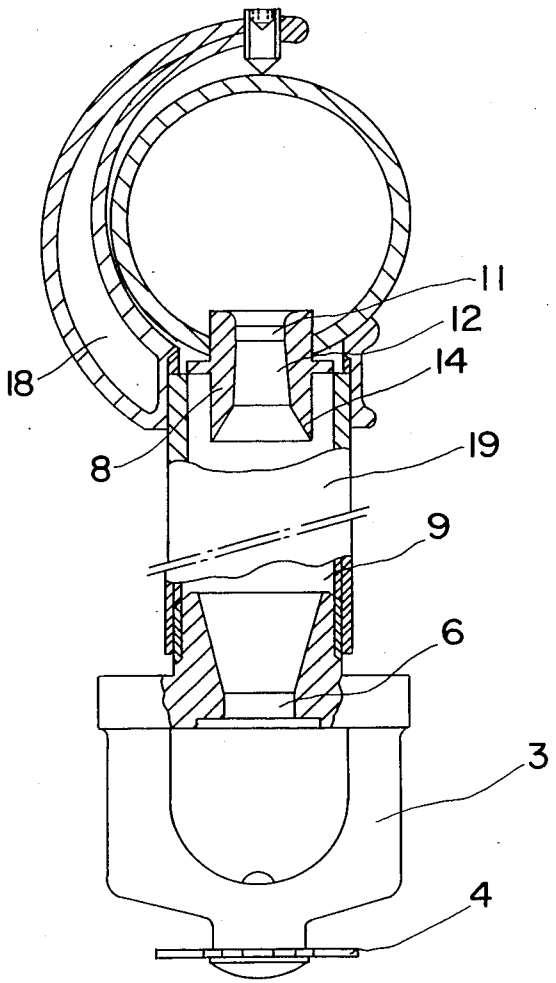
FIG. 6 illustrates an embodiment with the sprinkler separate from a diffuser and employing a C clamp.

The potential for separating the sprinkler from the diffuser, meaning of course the intake opening from the outlet opening, is illustrated in FIG. 6. The sprinkler can be of usual design. Venturi insert 8, which is accommodated in a C clamp 18 of the type conventional for fitting sprinklers, matches the particular sprinkler size in this case as well. The constriction or eddy chamber 9 is extended with the remaining space or with a length 19 of pipe. Since the cross-section of diffuser 12 is constricted, its outside dimensions can also be kept small. An only relatively small communicating bore is accordingly necessary, facilitating installation and packing.

Figure 7:
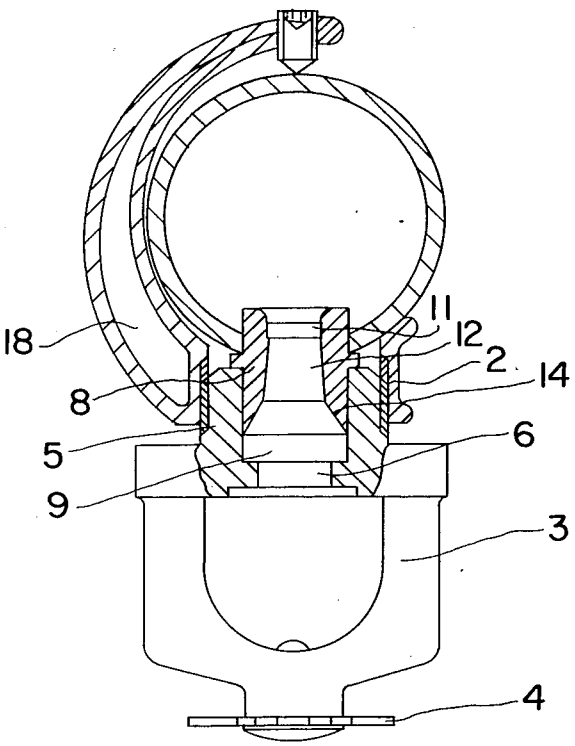
FIG. 7 illustrates another method of connecting the sprinkler to the pipeline by means of a C clamp.

FIG. 7 illustrates how a sprinkler of the type illustrated in FIG. 2, with a built-in diffuser 12 and constriction, can be installed with a C clamp 18. Installation and packing are simple and easy in this case as well.

Figure 8:
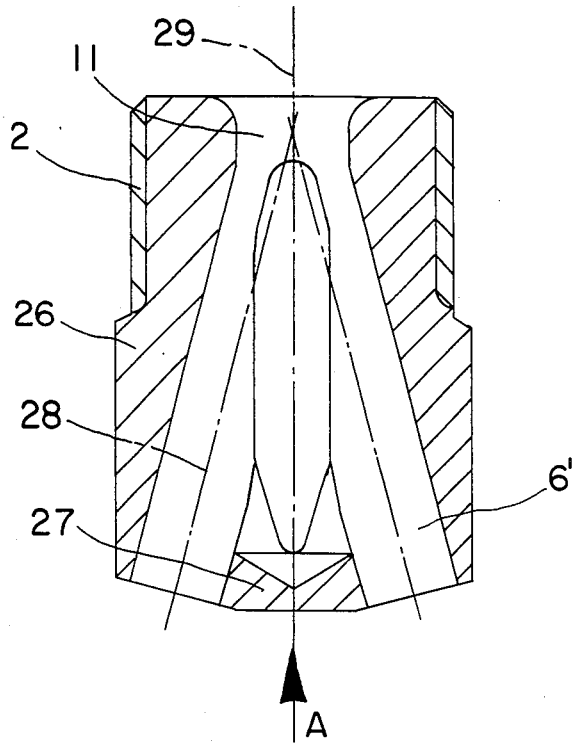
FIG. 8 is a section through and a view along the direction indicated by arrow A of an embodiment of a sprinkler with one intake opening and several outlet openings.
Figure 8A:
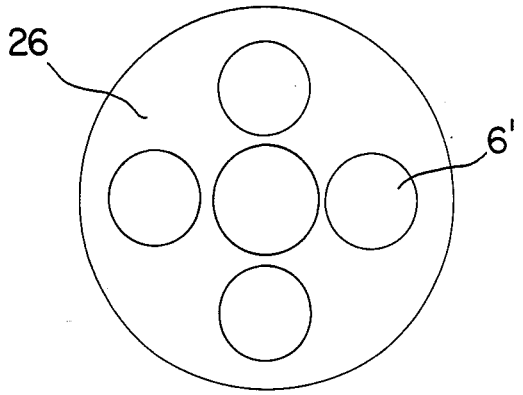
FIG. 8A is a bottom plan view of FIG. 8.

In contrast to the embodiments illustrated in FIGS. 2 through 7, the intake opening 11 and outlet opening 6 i the embodiment illustrated in FIG. 8 are combined into a common main nozzle component 26 with a connector thread 2. Outlet opening 6 is in the form of four bores 6' distributed uniformly around the circumference with their axes at an angle of 15° to the central axis of the main component. The midlines 28 of bores 6' in this design intersect with the midline 29, which coincides with the axis of the main component, of intake opening 11 when projected. The constriction or eddy chamber that impedes the free passage of fire-extinguishing agent is created by the central section 27 of main nozzle component 26.

Figure 9:
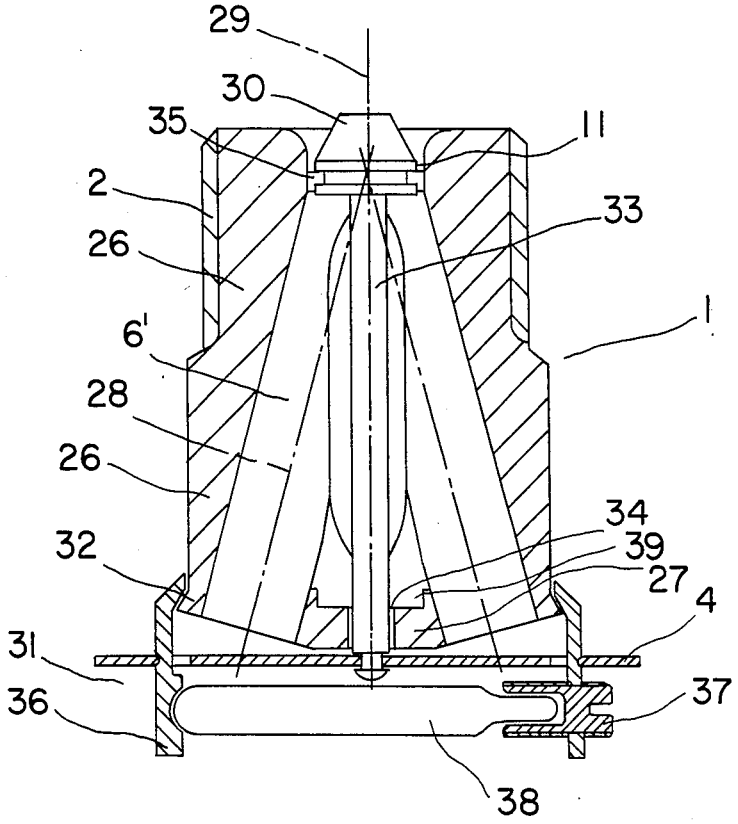
FIG. 9 illustrates a slight modification of the sprinkler nozzle with cap, a deflector , and a release mechanism.

FIG. 9 illustrates how a main nozzle component 26 that is a slightly modified version of the one illustrated in FIG. 8, with a cap 30, a release mechanism 31, and a spray disk 4 can be attached to a sprinkler 1.

This main nozzle component 26, in contrast to the one illustrated in FIG. 8, has an annular collar 32 around its bottom edge and a central section 27 that is somewhat differently designed to accommodate cap 30 and provide passage for a tie rod 33 between spray disk 4 and the cap. Section 27 also has a central bore 34. An automatic sprinkler 1 is represented in the ready position. Cap 30 is located along with an annular packing 35 at the level of narrowest cross-section, specifically in the vicinity of intake opening or nozzle 11, where it is secured with tie rod 33 and spray disk 4 by means of the components 36, 37, and 38 of release mechanism 31 until it is activated by a fire. The essential advantage is that the cross-section of cap 30 can be relatively small, so that the pressure of the fire-extinguishing agent need exert only a relatively weak force against it and it can easily be kept closed. This entails the further advantage that rapid-response triggering components such as a soldered component or the illustrated glass bulb 38 can be employed.

Once the heat of a conflagration has destroyed glass bulb 38, the bottom ends of clamps 36 and 37 can pivot in and their upper ends will separate from annular collar 32. The pressurized fire-extinguishing agent in the pipeline will then open cap 30 and displace spray disk 4 out of the closed and into the open position by means of tie rod 33, in which state cap 30 rests in the annular depression 39 in midsection 27. The fire-extinguishing agent can then escape. The face of cap 30 will also exert a transverse-distribution action on the agent and constrict it or cause it to eddy.

To demonstrate the overall validity of the principle behind the invention—the principle of combining two different flow constants by positioning a smaller nozzle upstream of an outlet-nozzle expansion downstream of the smaller nozzle and of impeding the free flow or outflow of the jet emerging from the smaller nozzle by means of a stationary resistance—a main nozzle component 26 such as that illustrated in FIG. 9, with a cap 30 and annular packing 35, a tie rod 33, and a spray disk 4, was constructed and tested. How the component was produced will now be described.

A piece of round stock 41 mm long and 35 mm in diameter was turned to an outside diameter of 30 mm, leaving an annular collar 32, and provided with an R ¾" thread up to 20 mm of its length. A blind hole 10 mm in diameter was bored from the threaded end, leaving a central section 27, to accommodate a cap 30, with an annular depression 39. Four bores 8 mm in diameter and distributed uniformly around the circumference were bored at an angle of 15° to the central axis 29 of main nozzle component 26 in such a way that their midlines 28 intersect the midline 29 of main nozzle component 26 or of intake opening 11 when projected. A cap 30 and annular packing 35 were inserted in the central bore as illustrated in FIG. 9 and connected to a spray disk 4 by means of a tie rod 33 through a bore 34 in central section 27. The truncated-conical section of cap 30 was designed with an angle of 30° and the face with a diameter of 6 mm.

Figure 11:
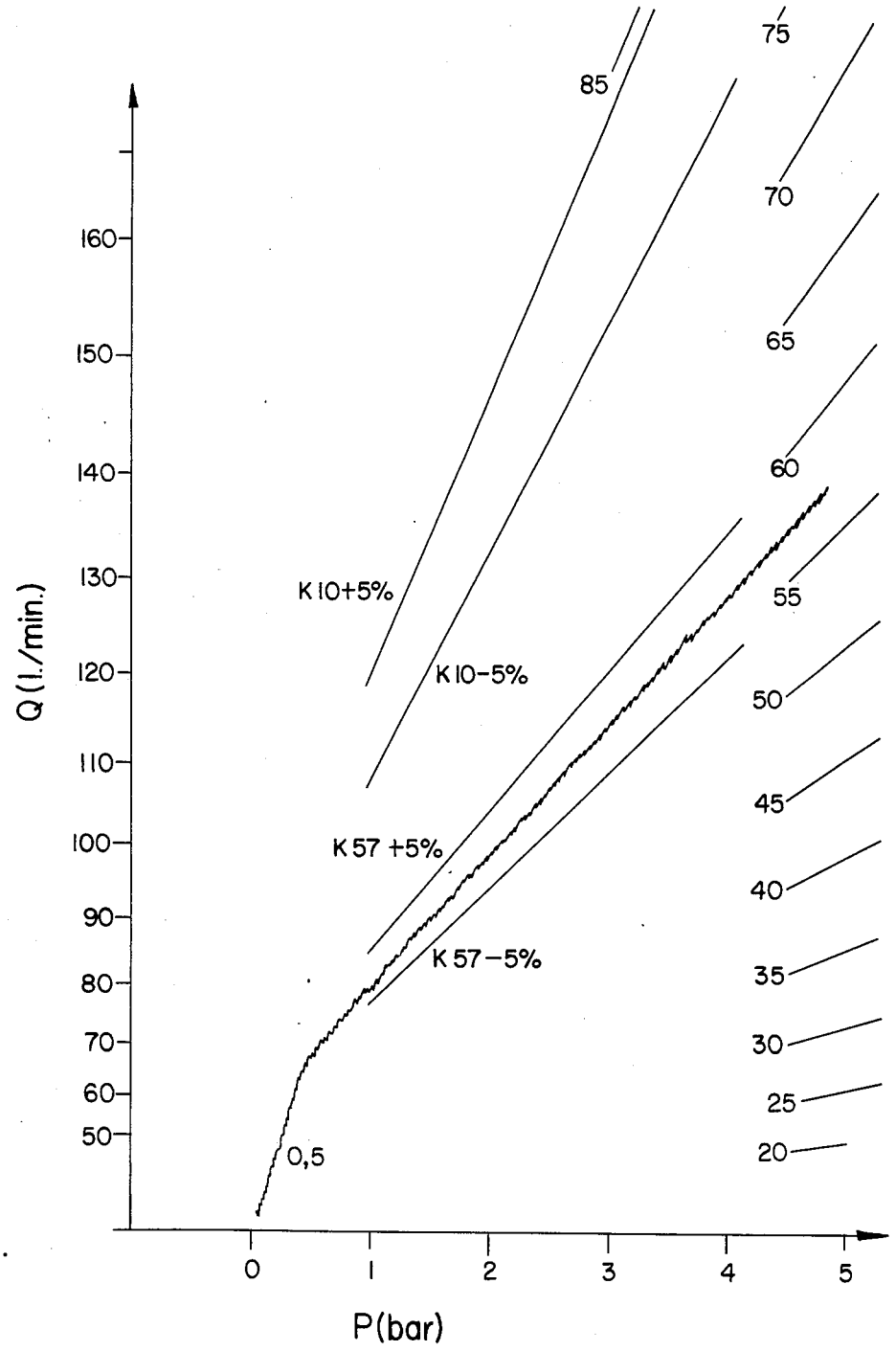
FIG. 11 is another graph illustrating the results of a test.

Flow measurements were conducted with this main nozzle component 26 open, with, that is, cap 30 resting on central section 27. The results of these tests in response to lift were completely unobjectionable and usable, as will be evident from the record illustrated in FIG. 11. The flow rate corresponded to the curve K 115 in FIG. 1 up to an above-atmospheric pressure of approximately 0.5 bar and to the curve KS 57 at higher pressures.

The potential for employing fast response release components makes the sprinkler in accordance with the invention illustrated in FIG. 9 practical as what is called in the field an early-suppression fast-response (ESFR) sprinkler.

The known ESFR sprinklers produce the large drops necessary for prompt suppression by means of large outlet openings and low delivery pressure. K 160 and recently even K 225 sprinklers for example have been employed with a correspondingly low delivery pressure. The supply pipes for these sprinklers must be specially designed, with relatively large diameters.

An ESFR sprinkler that can be operated either in existing pipelines or in particular in pipelines that employ elevated pressure is available for use with the sprinkler illustrated in FIG. 9, which is also a suspended dry-head sprinkler in the illustrated system. This, in addition to the aforesaid advantages, also decreases the expense of the pipeline.

A wide range of embodiments of the sprinkler in accordance with the invention and of methods of installing it is naturally possible. It is practical to design a sprinkler that is both compact and absolutely reliable by building the combination of nozzles into the sprinkler or making it a component of the sprinkler nozzle.

Figure 10:
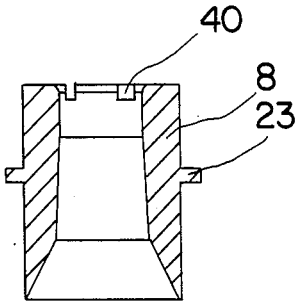
FIG. 10 illustrates how the nozzle can be designed with torsion slots.
Figure 10A:
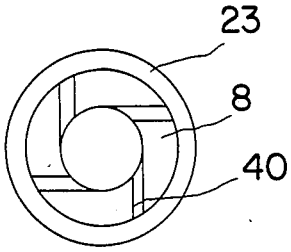
FIG. 10A is a top plan view of FIG. 10.

A practical effect can be obtained by, as illustrated in section and in plan in FIGS. 10 and 10*a*, respectively, associating tangential accesses 40 with intake opening or nozzle 11 and moderately rounding off the intake. This measure generates a torsion that acts on the conical exit of the water from intake opening 11, allowing a wider angle of expansion in diffuser 12, so that the overall length of the device in accordance with the invention can be shorter at an equal diameter. Since some of the energy of the fire-extinguishing agent is converted into torsional energy and the water exits from a completely conical nozzle, the cross-sections of intake opening 11 and of outlet opening 6 can be larger at equal flows Total utilization of diffuser 12 can also be ensured by splashing some of the water back from the flat annular surface 20 that surrounds outlet opening 6 and that is positioned perpendicular to the direction of flow. This measure also employs turbulence to consume kinetic energy that is not needed for pressure conversion. A design of this type is implied in FIGS. 2 and 3, where the open cross-section of outlet opening 6 results from the annular collar-like constriction 21. Constriction 21 can also be provided as illustrated in FIGS. 2 and 3 with a taper 22, although outlet opening 6 can also be cylindrical over the total height of annular shoulder 21.

It is understood that the specification and examples are illustrative but not limitative of the present invention and that other embodiments within the spirit and scope of the invention will suggest themselves to those skilled in the art.

What is claimed is:

1. In a sprinkler or spray nozzle for on-site fire-extinguishing systems provided with at least one intake opening (11) and with at least one outlet opening (6) downstream of the intake opening, and provided between the openings (11) and (6) with a connector with an open cross-section that initially expands like that of a diffuser from the intake opening toward the outlet opening over at least part of its length and then contracts into a constriction (9) positioned between the intake opening and its associated outlet opening, the improvement wherein the open cross-section of the intake opening is smaller than the open cross-section of the outlet opening in such a way and that the initial expansion of the open cross-section of the connector like that of a diffuser is so formed that the pressure of an extinguisher fluid in the open cross-section of the intake opening decreases to the vapor pressure of the extinguisher fluid if the above atmospheric pressure of the extinguisher fluid exceeds a predetermined value so that at an above-atmospheric pressure of the actual extinguisher fluid from 0 bar to the predetermined value, the outflow rate Q of the sprinkler/nozzle will be determined by the formula $$Q = K\sqrt{p}$$

and at a higher above-atmospheric pressure of the extinguisher fluid by the formula $$Q = KS\sqrt{p+1},$$

wherein

Q=flow rate in liters per minute,

K=flow rate in liters per minute at an above-atmospheric pressure of 1 bar,

KS=flow rate in liters per minute at 1 bar of pressure drop between entry into and exit from the intake opening cross-section, and p=above-atmospheric pressure upstream of the sprinkler.

2. A sprinkler or spray nozzle according to claim 1, wherein the predetermined above-atmospheric pressure is at most 5 bar.

3. A sprinkler or spray nozzle according to claim 1, wherein the predetermined above atmospheric pressure is at most 0.5 bar.

4. A sprinkler or spray nozzle according to claim 1, wherein the constriction (9) is a cylindrical pipe.

5. A sprinkler or spray nozzle according to claim 1, wherein each intake opening (11), outlet opening (6), and connector has a circular open cross-section.

6. A sprinkler or spray nozzle according to claim 1, wherein each intake opening (11) is in the form of an eccentric, tangential torsion slot or access (40).

7. A sprinkler or spray nozzle according to claim 1, wherein the intake end of each intake opening (11) is rounded off.

8. A sprinkler or spray nozzle according to claim 1, wherein the outlet opening (6) is centrally located and has an annular shoulder (21) that extends into it and has, toward the side of the intake opening, a flat surface (20) perpendicular to the axis of flow and a sharp inner adge.

9. A sprinkler or spray nozzle according to claim 8, wherein the outlet end of the annular shoulder (21) has a conical expansion (22).

10. A sprinkler of spray nozzle according to claim 1, provided with a plurality of outlet openings (6), the nozzle including a central backup plate (27) between the outlet openings.

11. A sprinkler or spray nozzle according to claim 10, including a cap (30) that is connected to a deflector (4) by a tie rod (33) which extends through the backup plate (27), the cap which tapers in toward the intake end being located in the intake opening (11) and held in position with the tie rod and the deflector by means of a release mechanism (31) until it is activated by a fire.

12. A sprinkler or spray nozzle according to claim 11, wherein the backup plate is designed to receive and hold the cap (30) when it is activated by a fire.

* * * * *